United States Patent [19]

Riddell

[11] 4,007,574

[45] Feb. 15, 1977

[54] STRUCTURAL MEMBER AND SYSTEM

[76] Inventor: C. Randolph Riddell, 4141 Tennyson, Houston, Tex. 77005

[22] Filed: Sept. 22, 1975

[21] Appl. No.: 615,162

[52] U.S. Cl. ..... 52/722; 52/726; 52/220; 52/731

[51] Int. Cl.[2] ..... E04C 3/34; E04C 3/30

[58] Field of Search ..... 52/722, 726, 720, 648, 52/251, 259, 434, 587, 583, 648, 220, 168, 731, 606

[56] References Cited

UNITED STATES PATENTS

| | | | |
|---|---|---|---|
| 1,572,669 | 2/1926 | Müller | 52/722 |
| 3,151,464 | 10/1964 | Sato et al. | 52/722 |
| 3,245,189 | 4/1966 | Reiland | 52/722 |
| 3,286,418 | 11/1966 | Radford | 52/612 |
| 3,367,084 | 2/1968 | Reiland | 52/722 |
| 3,372,448 | 3/1968 | Neys | 52/722 |
| 3,451,184 | 6/1969 | Stewart | 52/722 |
| 3,456,413 | 7/1969 | Fischer | 52/726 |
| 3,613,325 | 10/1971 | Yee | 52/722 |
| 3,783,565 | 1/1974 | Hughes | 52/722 |
| 3,916,592 | 11/1975 | Morohashi et al. | 52/723 |

*Primary Examiner*—Price C. Faw, Jr.
*Assistant Examiner*—Robert C. Farber
*Attorney, Agent, or Firm*—Pravel, Wilson & Gambrell

[57] ABSTRACT

An elongated structural member of substantially triangular cross-section incorporating either one longitudinally extending continuous passageway of circular cross-section whose center is located at or near the center of the cross-section of the member or a cluster of passageways whose center is similarly located with a member so constructed employed to transmit forces in compression, tension, shear, bending, torsion and any combination thereof and the passageway employed as conduit for air, water, electrical wiring and the like and in the construction of buildings such members specifically designed to serve as beams, columns, or struts.

6 Claims, 7 Drawing Figures

STRUCTURAL MEMBER AND SYSTEM

BACKGROUND OF THE INVENTION

The invention described herein relates to structural members. In most buildings, these are beams, columns, and struts. Structural members are employed to transmit forces in compression, tension, shear, bending, torsion and any combination thereof.

In order to accomplish such transmission, a suitable material is selected and a cross-sectional shape of the member is selected. Properties of the material selected influence the choice of cross-sectional shape and vice-versa.

In addition to this mutual influence, there are features of cross-sectional shape which have similar effects on all materials. These features relate to the mode of transmission of the force applied. The shapes generally used in current practice achieve popularity by providing a measure of efficiency of material used while transmitting force in some combination of the modes cited. A particular shape which especially favors one mode of transmission may not favor transmission of force in the other modes. It is desired to discover a shape which achieves very good transmission of force in a combination of modes while maintaining efficiency of material used.

The distribution of material over the cross-section of the member required to transmit a given force is determined by the factors governing the failure of the material or member in the mode of force transmission employed. In compression, the material may fail by crushing or the member which the material composes may fail by buckling. The former is discouraged by increasing the cross-sectional area subjected to the compressive force. The latter is discouraged by symmetrically distributing the cross-sectional area at a distance from the centroid of the area. An equilateral triangular distribution has been suggested for the transmission of pure axial compression in *Archive for Rational Mechanics and Analysis*, Vol. 5, No. 4, 1960, pp. 275–285, "The Shape of the Strongest Column", Joseph B. Keller, communicated by C. Truesdell and *Product Engineering*, Aug. 29, 1966, pp. 97–102, "Odd shapes and materials save weight in structures", Nicholas P. Chironis.

In tension, the material may fail by splitting or tearing. Such failure is encouraged by the formation of sharp radii in the material. Such failure is discouraged by increasing the cross-sectional area subjected to the tensile force and the maintenance of large radius boundaries of the cross-sectional shape of the member.

In shear, the material may fail by splitting or tearing as in tension. Such failure is discouraged by the techniques suggested with regard to tension. The avoidance of sharp radii promotes a smooth flow of shear stress over the cross-sectional shape thereby discouraging failure of the material.

In bending, the material of which the member is composed is subjected to both compression and tension. These modes of transmission occur in distinct zones of the cross-sectional shape of the member. The interface between these zones is called the neutral axis. In the case of an I-beam supported at its opposite ends and a downward load at its center, compression occurs in the upper portion and tension occurs in the lower portion. The shape of the compression zone must discourage compressive failure. The shape of the tension zone must discourage tensile failure. The magnitudes of the compressive and tensile forces in pure bending are inversely related to the distance of the centroid of the specific zone from the neutral axis. It is advantageous, therefore, to have a compression zone and a tension zone whose centroids are displaced from the neutral axis.

In bending, the material of which the member is composed is also subjected to shear. Transmission of force in this mode additionally requires that the cross-sectional shapes of the compressive and tension zones have no sharp radii and be connected in such manner as to promote a smooth flow of shear stress over the entire cross-sectional shape.

In torsion, the material of which the member is composed is subjected to both tension and shear. The magnitudes of the tensile and shear forces in pure torsion are inversely related to the distance of the force transmitting material from the axis of applied torque. It is advantageous to arrange the force transmitting material symmetrically about this axis in a continuous shape thereby forming a tube.

A single cross-sectional shape which satisfies the above criteria would be especially useful where combinations of force transmission modes are required. Most structures present such a requirement. In buildings, beams are required to transmit forces in the following descending hierarchy of modes: bending, shear, torsion, tension, compression. Columns are required to transmit forces in the following descending hierarchy of modes: compression, bending, shear, torsion, tension. Other structures involve other-named members which present other hierarchies of force transmission requirements.

Reinforcing elements such as steel rods have been previously used in concrete structures. The use of secondary meshes with such reinforcing elements is disclosed in U.S. Pat. No. 1,233,053 issued July 10, 1917 to R. B. Harinian.

In the construction of a building, non-structural elements as electrical wiring, plumbing, ventilation, sprinkler systems and the like are commonly installed by separate trades in conduits which are separate and distinct from the structural members. In U.S. Pat. No. 2,809,074 issued Oct. 8, 1957 to J. L. McDonald, it has been proposed to use a metal pipe component in a metallic structural unit as a conduit for a fire extinguisher system.

SUMMARY OF THE INVENTION

The present invention relates to a new and improved structural member and a new and improved structural system embodying the member wherein the member is an elongated structural member having a substantially triangular cross-section along the longitudinal axis of the member and a longitudinal passageway of circular cross-section extending through the member parallel to the longitudinal axis with the passageway center located at or near the centroid of the member. Electrical wiring, plumbing, ventilation, sprinkler systems and the like are installed using the passageways to eliminate the need for conduits separate from the structural members. The structural system may be a building framework skeleton with side, floor and roof units added to form a building.

An object of the invention is to provide features of the cross-section of a structural member which will be of advantage to other functional requirements of the environment in which the structural member is installed.

Another objective of the invention is to provide a structural member of reduced weight as compared to the weight of a structural member utilizing one of the traditional convex solid cross-section shapes in general use.

Another objective of the invention is to provide a reduction of effort required in fabrication of structural members as compared to the effort required in the fabrication of structural members utilizing traditional convex solid cross-section shapes.

Another objective is to provide a structural member which incorporates passageways, which serve the same purpose as separate conduits, for electrical wiring, plumbing, ventilation, sprinkler systems and the like.

The above objectives, as well as other objectives as will be apparent, are simultaneously achieved in an elongated structural member of substantially triangular cross-section incorporating either one longitudinally extending continuous passageway of circular cross-section whose center is located at or near the center of the cross-section of the member or a cluster of said passageways whose center is similarly located.

The following drawings and descriptions thereof are intended to describe the preferred embodiments of the invention with the claims setting forth the scope of the invention.

DESCRIPTION OF THE PREFERRED EMBODIMENTS

Figure 1:
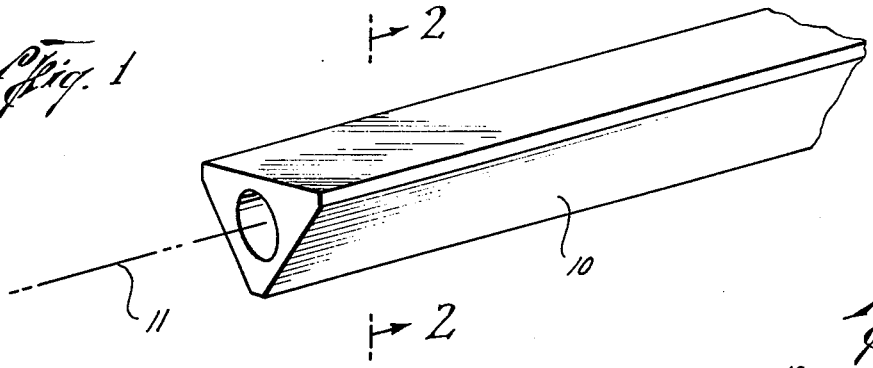
FIG. 1 is a perspective view of a structural member incorporating the invention.
Figure 2:
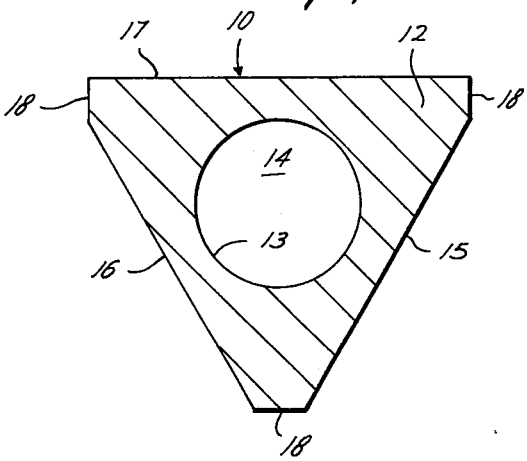
FIG. 2 is an enlarged transverse section view of the structural member on line 2—2 of FIG. 1 which shows the substantial triangular cross-section and circular passageway which together compose the invention.

Referring in detail to the drawings, FIG. 1 shows a portion of an elongated structural member 10 having a longitudinally extending axis designated as 11 at the geometric center or centroid of the member. The cross-section as shown in FIG. 2 shows the substantially triangular cross-section 12 of the member. A continuous passage of circular cross-section defined by inner surface 13 of passageway 14 is located at or near the geometric center or centroid of the substantially triangular cross-section of the member 10. The member 10 includes three outer faces 15, 16 and 17 that form the outer surface of the member. The points of intersection or corners 18 of the member may be truncated as a practical expedient to avoid chipping of an otherwise sharp corner or, at greater extents, an accommodation of other design objectives, but shall not violate the substantial triangularity of the cross-section until the extent of truncation produces a cross-section of regular, hexagonal shape or intersects the passageway.

Figure 3:
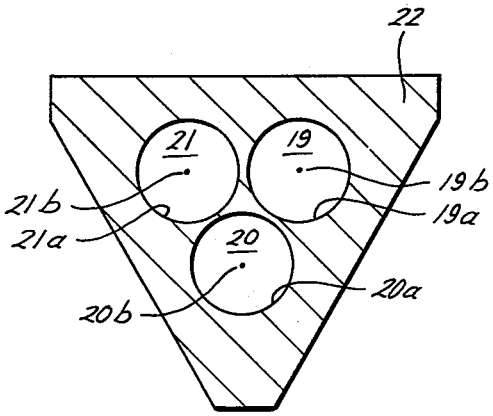
FIG. 3 is an enlarged transverse section view of a structural member incorporating the invention in an alternative form wherein a cluster of three circular passageways are combined with the substantial triangular cross-section.

FIG. 3 shows an embodiment of the member having a cluster of passageways 19, 20 and 21 defined by their respective inner surfaces 19*a*, 20*a* and 21*a*. The cluster of passages of circular cross-section have their centers located at or near in surrounding relationship the centroid of the substantially triangular cross-section of the member. The centers 19*b*, 20*b* and 21*b* of the passages are positioned on the locus of a circle having a radius extending from the centroid of the member 22. All of the other features of the cross-section of member 22 are identical to those identified above with reference to the embodiment of FIG. 2.

Figure 4:
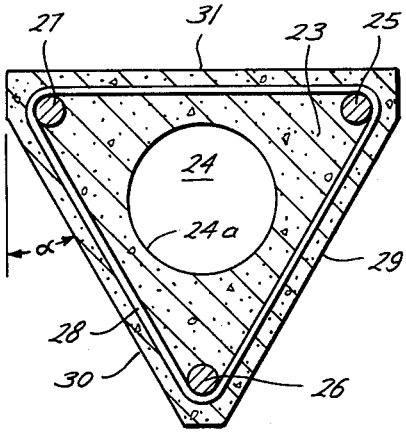
FIG. 4 is an enlarged transverse section view of a structural member incorporating the invention in an alternative form wherein the choice of material requires the use of reinforcing elements located entirely within the substantially triangular exterior boundary of the member.
Figure 5:
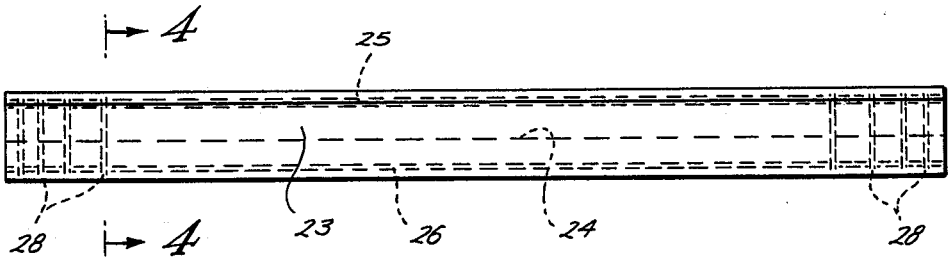
FIG. 5 is an elevation view of the structural member, shown in transverse section on line 4—4 in FIG. 4, which shows the longitudinal disposition of reinforcing elements.

Referring to FIGS. 4 and 5, a wide selection of materials is presently available and a wider selection of materials will be available in the future from which to compose a structural member as specified herein. Whenever the material chosen requires the incorporation of a reinforcing element or elements, the reinforcement is installed entirely within the substantially triangular exterior boundary of the cross-section of the member. A structural mix of portland cement concrete is one particularly useful choice of material for the implementation of the invention. FIG. 4 shows a chosen arrangement of a structural member 23 made of portland cement concrete having a passageway 24 defined by the inner surface 24*a*. Tensile elements 25, 26 and 27 extend longitudinally through the member 23 and are spaced from the centroid of the member. The tensile elements 25, 26 and 27 may be either prestressed or non-prestressed with the elements located at the corners of the member 23. Closed stirrup-shaped tensile elements 28 are attached to the tensile elements 25, 26 and 27 and add additional strength to the member. A force may be applied to the longitudinal reinforcing elements 25, 26 and 27 and concrete poured around the elements so that release of the force after the concrete has cured will provide a prestressed member. The stirrup-shaped elements 28 interconnecting the rods carry transverse tensile forces.

In fabricating the structural member, construction of the forms, placement of the reinforcing elements 25, 26, 27 and 28, placement of the concrete 23 and stripping of the forms can be accomplished by conventional procedures for either precast or cast-in-place construction. Construction of the forms may be simplified as forms may need to be only placed on surfaces 29 and 30 without placing a form on surface 31. The passageway 24 may be formed by any of various procedures, the choice of which is influenced by the type of construction of the member, that being either precast or cast-in-place.

For precast construction, the passageway 24 may, for example, be formed by a mandrel and sleeve procedure. This procedure is appropriate if the sleeve is not strong enough to support the pressure of the wet concrete. In such a case, a mandrel of sufficient strength is inserted in the sleeve before the concrete is placed.

When the concrete is cured, the forms are removed, the mandrel is withdrawn, and the sleeve remains in place.

For cast-in-place construction, the passageway 24 may, for example, be formed by a cast in sleeve procedure wherein the sleeve is of sufficient strength to alleviate the need of a supporting mandrel and is left inside the member.

The concrete member constructed as above may be installed to serve either as a beam or as a column. As a column, the member is erected with its longitudinal axis oriented in a generally vertical direction. In this application, the passageway 24 or multiple passageways 19, 20 and 21 as shown in FIG. 3 may serve as a substitute for conduits for ventilation, plumbing, wiring and the like. Utility of the passageway 24 or passageways 19, 20 and 21 may be enhanced by providing access, such as by opening, to them through the faces 29, 30 and 31 of the member. The angle $\alpha$ (See FIG. 4) of the faces 29 and 30 of the member 23 from an axis perpendicular to the longitudinal axis of the member provides an efficient surface for reflecting light or sound into the space surrounding the member.

As a beam, the member may be installed with its longitudinal axis oriented in a generally horizontal plane. In this application the passageway 24 or passageways 19, 20 and 21 as in FIG. 3 may also serve as conduits for ventilation, plumbing, wiring and the like. Again the utility of the passageways may be enhanced by providing access to them through the faces of the member. Also the angle $\alpha$ (FIG. 4) of the faces of the member from a vertical axis perpendicular to the longitudinal axis of the member may be used to provide an efficient surface for reflecting light or sound into the space below or to the side of the member in like manner as when the member is used as a column.

Figure 6:
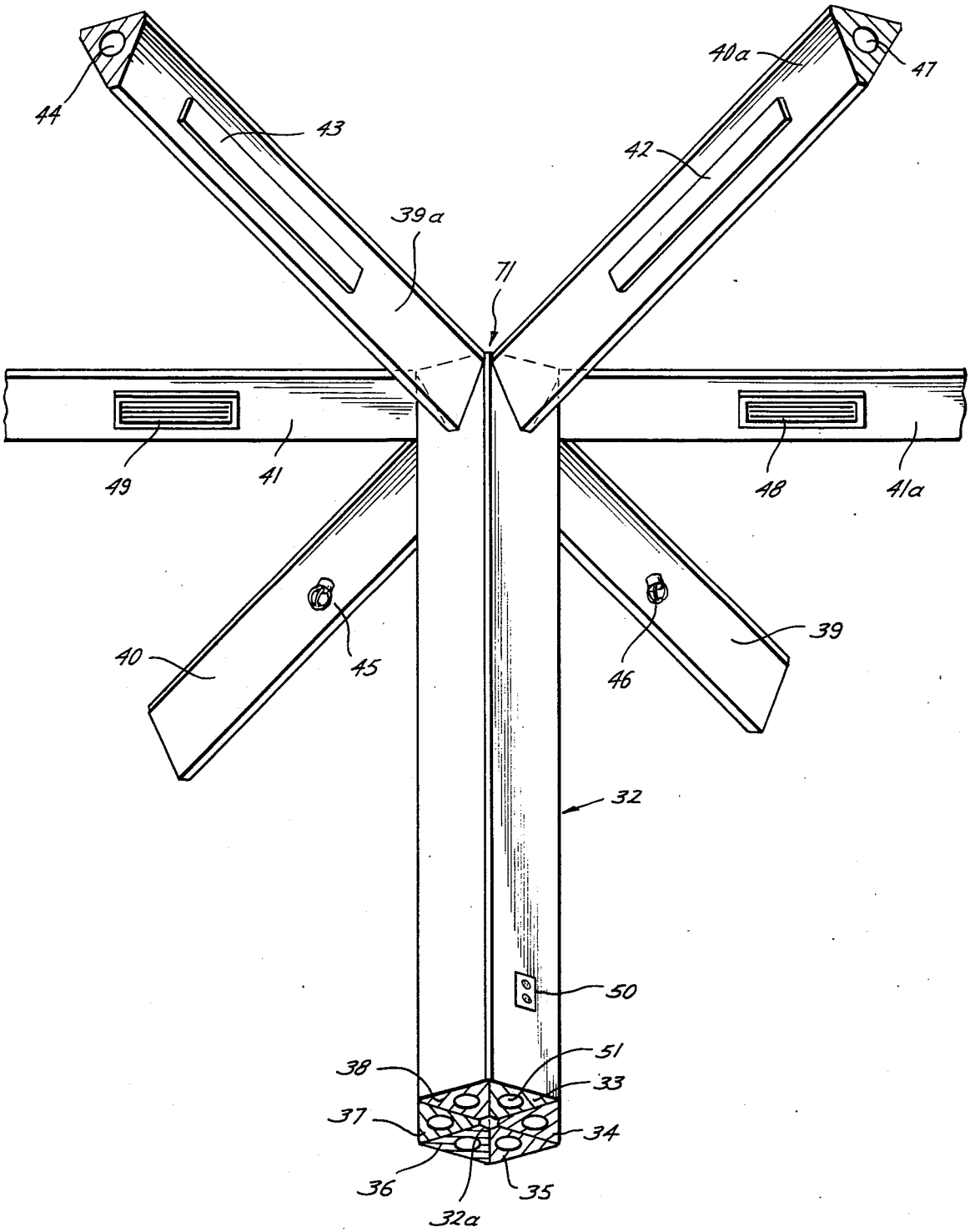
FIG. 6 is a perspective view of a structural system whose members, incorporating the invention, are employed as beams and columns in such manner as to utilize all features of the invention.

Referring to FIG. 6, a column 32 is formed from a cluster of six triangular structural members 33, 34, 35, 36, 37 and 38 which are constructed as proposed by this invention. The truncated edges of the triangular members provide a central passageway 32*a*. Beams 39, 39*a*, 40, 40*a*, 41 and 41*a* are connected to the column 32 at 71 and may be secured thereto or formed as a single unit when cast-in-place. In particular, all the above structural members have a substantially equilateral triangular cross-section with one passageway located at the center of the cross-section of each member and all are composed of a structural mix of portland cement concrete using light weight aggregates reinforced with non-prestressed reinforcing steel tensile elements such as shown in FIG. 5. This system is composed of cast-in-place, steel reinforced, light weight concrete.

Illumination elements 42 and 43 may be attached to beams 39*a* and 40*a* with an opening in the beam connecting with the passageway 44 in the beam 39*a* and passageway 47 in the beam 40*a* serving as a conduit for the wiring to the illumination elements 42 and 43. Sprinkler elements 45 and 46 may be attached to faces on the beams 39 and 40 with the passageways in these beams (not shown) serving as conduits for water to the sprinkler heads. Ventilating system grills 48 and 49 may be connected at openings in the beams 41*a* and 41 leading to the beam passageways (not shown) in beam 41*a* and 41 such that the passageways in the beams serve as ducts for heated and cooled air. Electrical outlet 50 may be placed on the column 33 with the electrical wiring for the outlet in passageway 51. It is understood that the use of the passageways in the columns and beams would depend upon the requirements for their application. The above structural system, by incorporating all features of the invention in all members of the superstructure of a building would provide an extremely economical and efficient alternative to a traditional cast-in-place concrete system composed of traditional members of solid convex cross-section.

Figure 7:
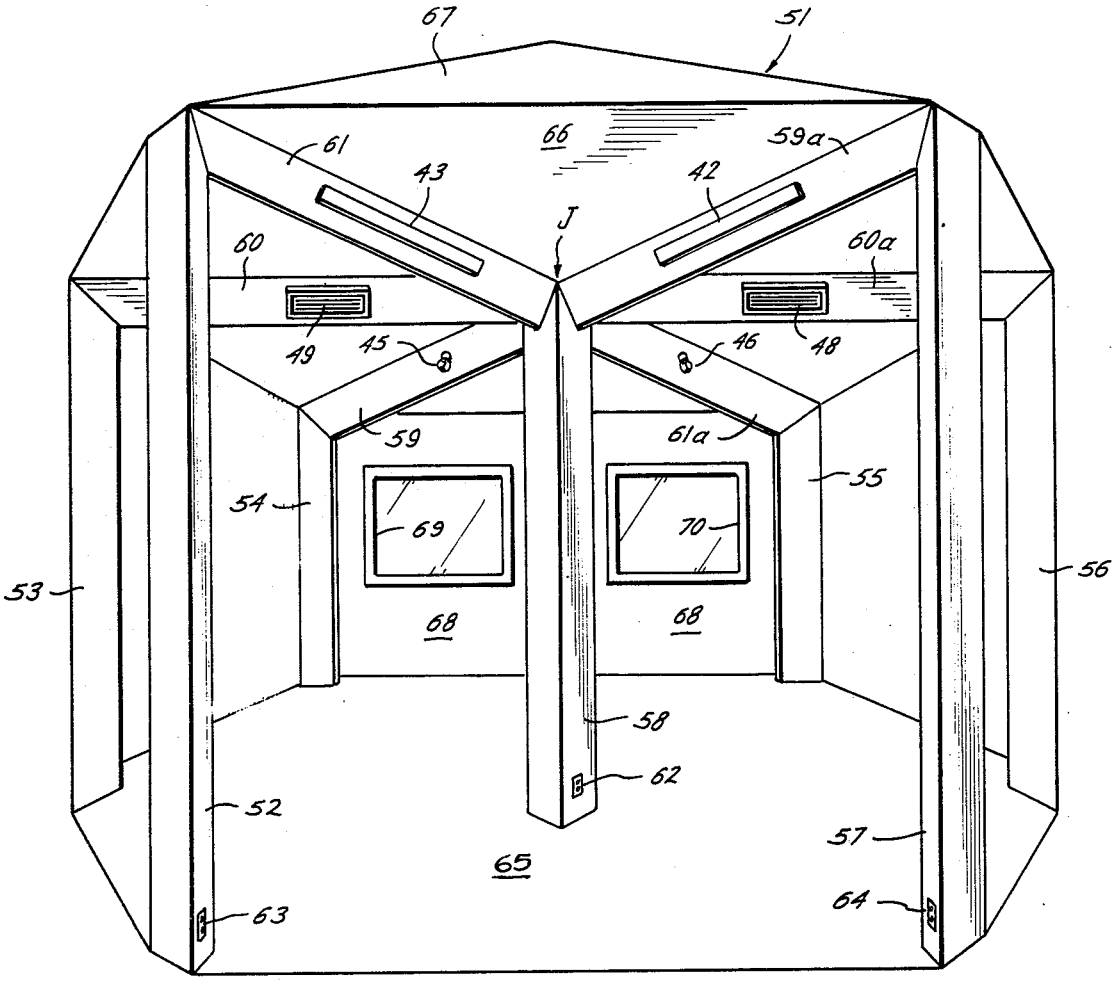
FIG. 7 is a perspective view of a single story building incorporating the structural system shown in FIG. 6.

An example of a building structure in which the structural member of the invention has application is shown in FIG. 7. The building, generally designated 51 includes a plurality of triangular columns 52, 53, 54, 55, 56 and 57 and a central column 58 formed of six triangular structure members joined together as in FIG. 6. Beams 59, 59*a*, 60, 60*a*, 61 and 61*a* are joined with the columns to form the framework for a structural system that forms the skeleton of a building. Illumination elements 42 and 43 may be positioned on the beams 61 and 59*a* as discussed above, sprinkler heads 45 and 46 may be positioned on beams 59 and 61*a* as discussed above, and ventilation outlets 48 and 49 may be positioned on beams 60*a* and 60 as also discussed above. Electrical outlets 62, 63 and 64 may be located on the columns as desired in the particular application. The floor structure 65 may be formed of cast-in-place reinforced concrete as is known in the art. The ceiling structure 66 may be the lower surface of a floor structure in the case of a multiple story application and may be typically a suspended ceiling as is well known in the art. Since a suspended ceiling is typically used to cover the additional conduits for electrical, plumbing and ventilation systems it may no longer be needed since the systems are incorporated in the framework structure of the beams and columns. A roof structure 67 is shown supported by the beams and columns. A wall structure 68, one of which is shown, having window structures 69 and 70 may be connected between the columns in a known manner. It is understood that such wall structures could also incorporate doors and the like as needed in each particular application. While the structure shown in FIG. 7 is a six sided structure, many variations in the arrangement of columns and beams would be apparent to those skilled in the art. It is also contemplated that multiple stories and multiple sections would be joined together or formed together to provide larger multistory building structures.

The joint J may be formed by making the beams into an integral unit using a cast-in-place method. Alternatively the beams could be interconnected and attached to the column structure using the precast method.

The foregoing disclosure and description of the invention are illustrative and explanatory thereof, and various changes in the size and materials of the generally triangular structural member having a generally circular passageway therethrough may be made without departing from the spirit of the invention.

I claim:

1. A structural system, comprising:

a plurality of elongated structural members having substantially triangular cross-sections along the longitudinally extending axis of the elongated members, and said structural members including means joining said members together to provide a support framework skeleton of vertical and horizontal structural components transmitting forces in compression, tension, shear, bending, torsion and any combination thereof;

said substantially triangular cross-sections providing each member with three outer faces;

each member having a substantially circular axial passage therethrough defining an inner surface of a substantially circular passageway extending parallel to the longitudinal axis of the member and substantially at the centroidal axis of the member to reduce the weight of the member; and non-supporting elements comprising electrical, plumbing, ventilation or sprinkler systems installed in said structural system for which said passageways serve as conduits.

2. The system of claim 1, wherein: the members are formed of concrete.

3. A structural system, comprising:

a plurality of elongated structural members having substantially triangular cross-sections along the longitudinally extending axis of the elongated members, and said structural members including means joining said members together to provide a support framework skeleton of vertical and horizontal structural components transmitting forces in compression, tension, shear, bending, torsion and any combination thereof;

said substantially triangular cross-sections providing each member with three outer faces;

each member having a plurality of substantially circular axial passages therethrough with each passage defining an inner surface of a substantially circular passageway extending parallel to the longitudinal axis of the member and located substantially about the centroidal axis of the member to reduce the weight of the member; and non-supporting elements comprising electrical, plumbing, ventilation or sprinkler systems installed in said structural system for which said passageways serve as conduits.

4. The system of claim 2, wherein:

the concrete members have reinforcing elements including longitudinally extending rods positioned adjacent the intersection or apex of the faces of the members to provide strength in compression, tension, shear, bending, torsion and any combination thereof.

5. The system of claim 4, wherein:

the reinforcing elements are prestressed as needed for load requirements.

6. The system of claim 4, wherein:

substantially triangular stirrups are connected to the rods to interconnect the rods and hold the rods in position and transmit transverse tensile forces.

* * * * *